US007495145B1

(12) United States Patent
Doyle, III et al.

(10) Patent No.: US 7,495,145 B1
(45) Date of Patent: Feb. 24, 2009

(54) REACTORS AND METHODS FOR OXIDIZING CHEMICAL OR BIOLOGICAL MATERIALS

(75) Inventors: Edward F. Doyle, III, Phoenix, MD (US); Brent L. Haroldsen, Manteca, CA (US); Timothy J. Shepodd, Livermore, CA (US); Benjamin C. Wu, San Ramon, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 855 days.

(21) Appl. No.: 10/761,917

(22) Filed: Jan. 15, 2004

(51) Int. Cl.
*A62D 3/38* (2007.01)

(52) U.S. Cl. ..... 588/320; 422/165; 588/401

(58) Field of Classification Search ..... 588/401, 588/320; 422/165; 110/237, 346
See application file for complete search history.

(56) References Cited

U.S. PATENT DOCUMENTS 6,881,383 B1 * 4/2005 Tschritter et al. ..... 422/165

FOREIGN PATENT DOCUMENTS

JP 409117735 A * 5/1997

* cited by examiner

*Primary Examiner*—Wayne Langel
*Assistant Examiner*—James Fiorito
(74) *Attorney, Agent, or Firm*—Ulysses John Biffoni

(57) ABSTRACT

The invention provides methods and a reactor for safely destroying containers having toxic chemical and biological materials contained therein. The reactor comprises a pressure vessel having an internal reaction chamber and at least one heater disposed on an exterior of the pressure vessel. A fragment-suppression system is also disposed within the internal reaction chamber. The fragment-suppression system is adapted to receive a container therein, such as an energetic chemical munition, and is adapted to receive a charge for opening the container. An injection port is also provided so that oxidants can be injected into said reaction chamber to neutralize the chemical and biological materials after the container has been opened.

10 Claims, 4 Drawing Sheets

REACTORS AND METHODS FOR OXIDIZING CHEMICAL OR BIOLOGICAL MATERIALS

STATEMENT OF GOVERNMENT INTEREST

The invention described herein may be manufactured, used, and/or licensed by or for the Government of the United States of America without the payment of any royalties thereon or therefor.

TECHNICAL FIELD OF THE INVENTION

The present invention relates generally to oxidation of chemical or biological materials. More particularly, this invention provides a system useful for oxidizing and neutralizing chemical and biological materials housed within containers, for example, energetic or non-energetic chemical munitions.

BACKGROUND OF THE INVENTION

Frequently, chemical or biological materials are contained in containers, such as a casing of an energetic or non-energetic munition, or containers containing Chemical Agent Instruction Sets (CAISs) which were used by the military as training aids to help prepare military personnel for chemical weapon attacks. In order to neutralize or destroy the chemical or biological materials, the containers are often opened in a protective enclosure using shape charges, for example. This may cause the burster used in energetic munitions to either burn or detonate. The contents are then neutralized using reagent neutralizers. However, many existing systems require a priori information or knowledge of the chemical or biological agent housed in the container so that a proper neutralizer can be used. Moreover, even after using the neutralizer the neutralized chemical or biological agents may still require post processing, such as incineration, to meet environmental regulations and laws.

Supercritical water oxidation (SCWO) is a process capable of destroying nearly all chemical and biological materials through oxidation. Supercritical water oxidation avoids the need for incineration and does not require a priori knowledge of the chemical or biological agent being destroyed. Supercritical water oxidation uses supercritical water, i.e., water at a temperature greater than 705.2 degrees Fahrenheit and a pressure greater than 3,200 psia. Supercritical water has a liquid-like density and a gas-like viscosity. Organic materials and gases become highly soluble in supercritical water, whereas inorganic materials are essentially insoluble. When oxygen is introduced, the organic materials are oxidized almost instantly, leaving only materials such as water and inorganic ions.

Many supercritical water oxidation systems use a continuous-feed or a steady-flow reactor. This involves adding water, an oxidizer, and the material to be destroyed or oxidized (the reactants) at inlets of the reactor, heating the reactants as they flow through the reactor, managing the heat of combustion, and collecting the products of the reaction at an outlet of the reactor. One problem with this is that when inorganic solids are present or are produced during the reaction, these solids frequently plug the reactor. Moreover, continuous-feed reactors typically do not provide an easy way to reprocess products that are not fully oxidized. Continuous-feed reactors are usually large, expensive, and complex, and tend to be fixed facilities due to their size. Further, continuous-feed reactors are not easily adapted for opening containers using shape charges or the detonation of energetic munitions.

Supercritical water oxidation processes can also be performed in batch reactors. Batch reactors typically involve using a pressure vessel in which the reactants are heated at a fixed pressure-vessel volume. That is, there are no flows into or out of the pressure vessel during heating. One batch reactor includes a heating element that projects into a central region of an interior of a pressure vessel for heating the reactants. The reactants in the central region are heated to supercritical conditions, while walls of the vessel are cooled, forming a subcritical region adjacent the walls. This establishes an internal circulation between the supercritical central region and the subcritical near-wall region that reduces corrosion of the walls and promotes rapid oxidation in the supercritical central region by constantly moving reactants into this zone while removing reaction products. However, batch reactors of this type are not easily adapted for opening containers using shape charges or the detonation of energetic munitions.

For the reasons stated above, and for other reasons stated below which will become apparent to those skilled in the art upon reading and understanding the present specification, there is a need in the art for alternatives for oxidizing chemical or biological materials that are contained within containers.

SUMMARY

The above-mentioned problems with oxidizing chemical or biological materials that are housed within containers and the difficulties of destroying energetic munitions are addressed by the present invention and will be understood by reading and studying the following specification.

Embodiments of the present invention provide a reactor capable of opening a container, such as an energetic or non-energetic munition containing a biological or chemical material, and oxidizing the biological or chemical material contained therein.

For one embodiment, the invention provides a reactor with a pressure vessel having an internal reaction chamber. At least one heater is disposed on an exterior of the pressure vessel. A fragment-suppression system is disposed within the internal reaction chamber. The fragment-suppression system is adapted to receive a container therein and is adapted to receive a charge for opening the container.

Further embodiments of the invention include methods and apparatus of varying scope.

DETAILED DESCRIPTION

Figure 1:
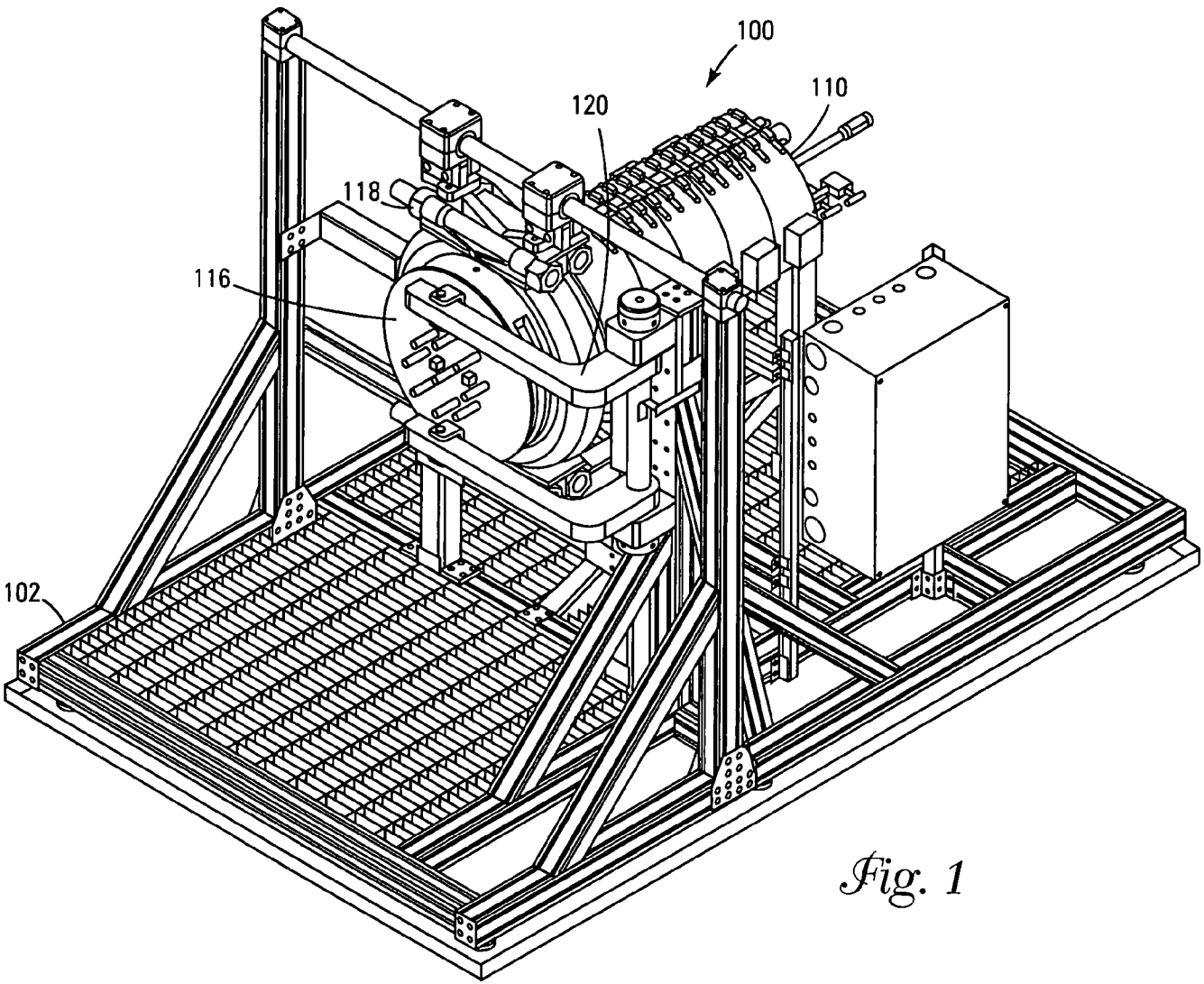
FIG. 1 is a perspective view illustrating a reactor according to an embodiment of the present invention.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, electrical, or other physical changes may be made without departing from the scope of the present invention. The following detailed description is, therefore, not to be taken in a limiting sense, and the scope of the present invention is defined only by the appended claims and equivalents thereof.

Figure 2:
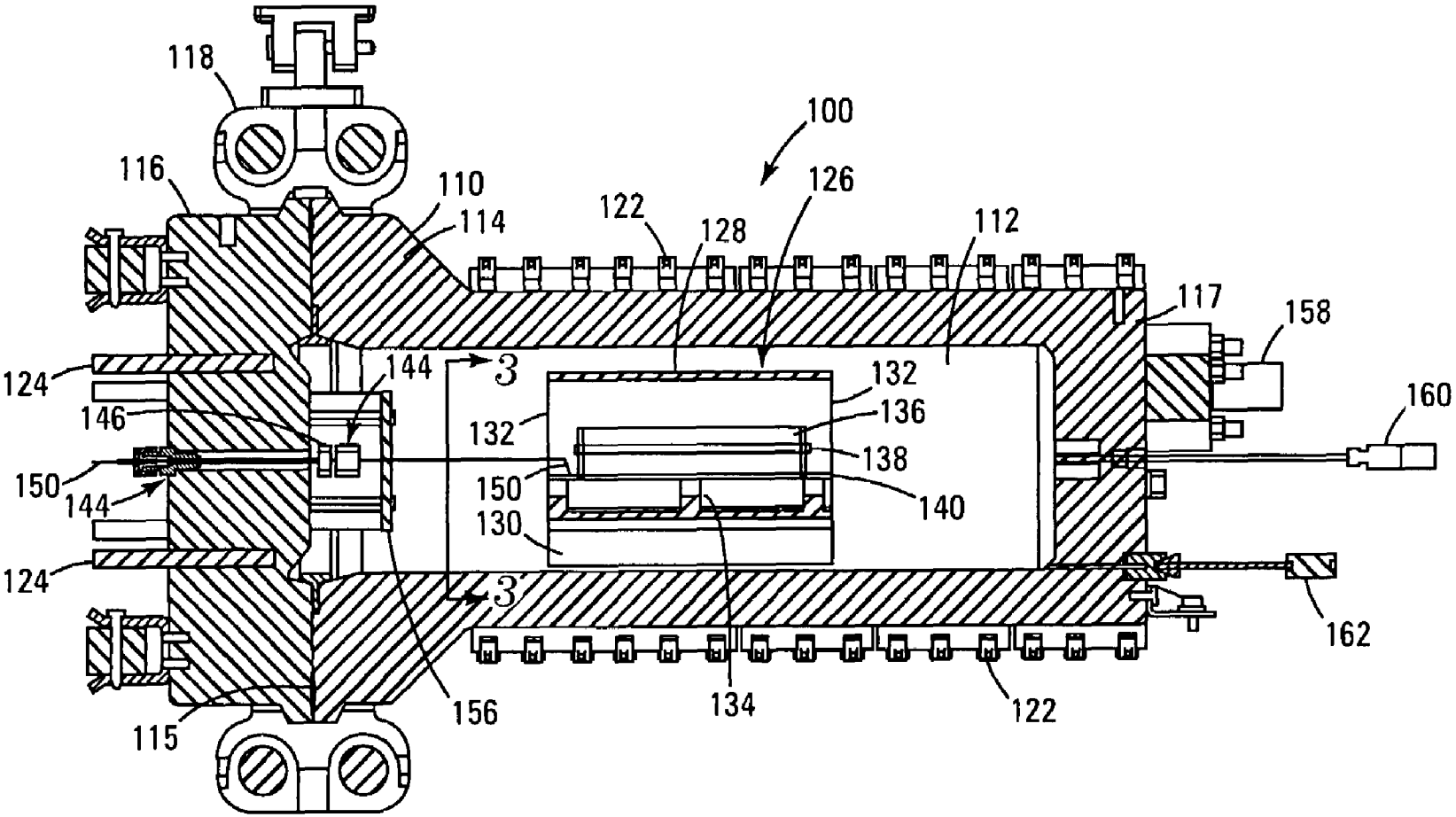
FIG. 2 is a cross-sectional side view of the reactor of FIG. 1.

FIG. 1 is a perspective view illustrating a reactor 100 mounted on a portable platform 102, such as a skid, a trailer bed, etc., according to an embodiment of the present invention. FIG. 2 is a cross-sectional side view of reactor 100. In one embodiment, reactor 100 destroys chemical or biological materials through oxidation, e.g., of an energetic or non-energetic chemical or biological munition or the chemical materials of a Chemical Agent Instruction Set (CAIS).

Reactor 100 includes a pressure vessel 110. Pressure vessel 110 has an internal reaction chamber 112 located within a body 114 of pressure vessel 110 and a cover 116 that removably and repeatedly seals against body 114 via a seal 115 disposed between cover 116 and body 114. For one embodiment, pressure vessel 110 is capable of operating at temperatures and pressures exceeding the critical temperature (about 705.2° F.) and pressure (about 3200 psia) of water and is capable of withstanding a pressure shock induced by detonation of an energetic munition of the type used for chemical or biological munitions. For example, pressure vessel 110 may comprise an ASME (American Society of Mechanical Engineers) pressure vessel that is ASME code stamped for 4900 psig at 1200° F. In addition, seal 115 may comprise a 718 Inconel GRAYLOC seal, manufactured by GRAYLOC Products, Houston, Tex., USA. For another embodiment, a clamp 118, such as a C-clamp, clamps cover 116 to body 114, squeezing seal 115 therebetween. For some embodiments, a hinge 120 pivotally attaches cover 116 to platform 102, as illustrated in FIG. 1. Clamp 118 may also be attached to platform 102, as shown in FIG. 1. In another embodiment, end cap 117 may be replaced by another cover, such as described for cover 116, so that reactor 110 may be opened at either end.

For one embodiment, heaters 122 are disposed on an exterior surface of body 114, as shown in FIG. 2, so as to make contact therewith. Heaters 122 can be ceramic band heaters, inductive heaters, or the like. For another embodiment, heaters 124, such as cartridge heaters, are embedded in cover 116, as shown in FIG. 2. In a preferred embodiment, each of heaters 122 and 124 can be individually controlled.

Figure 3:
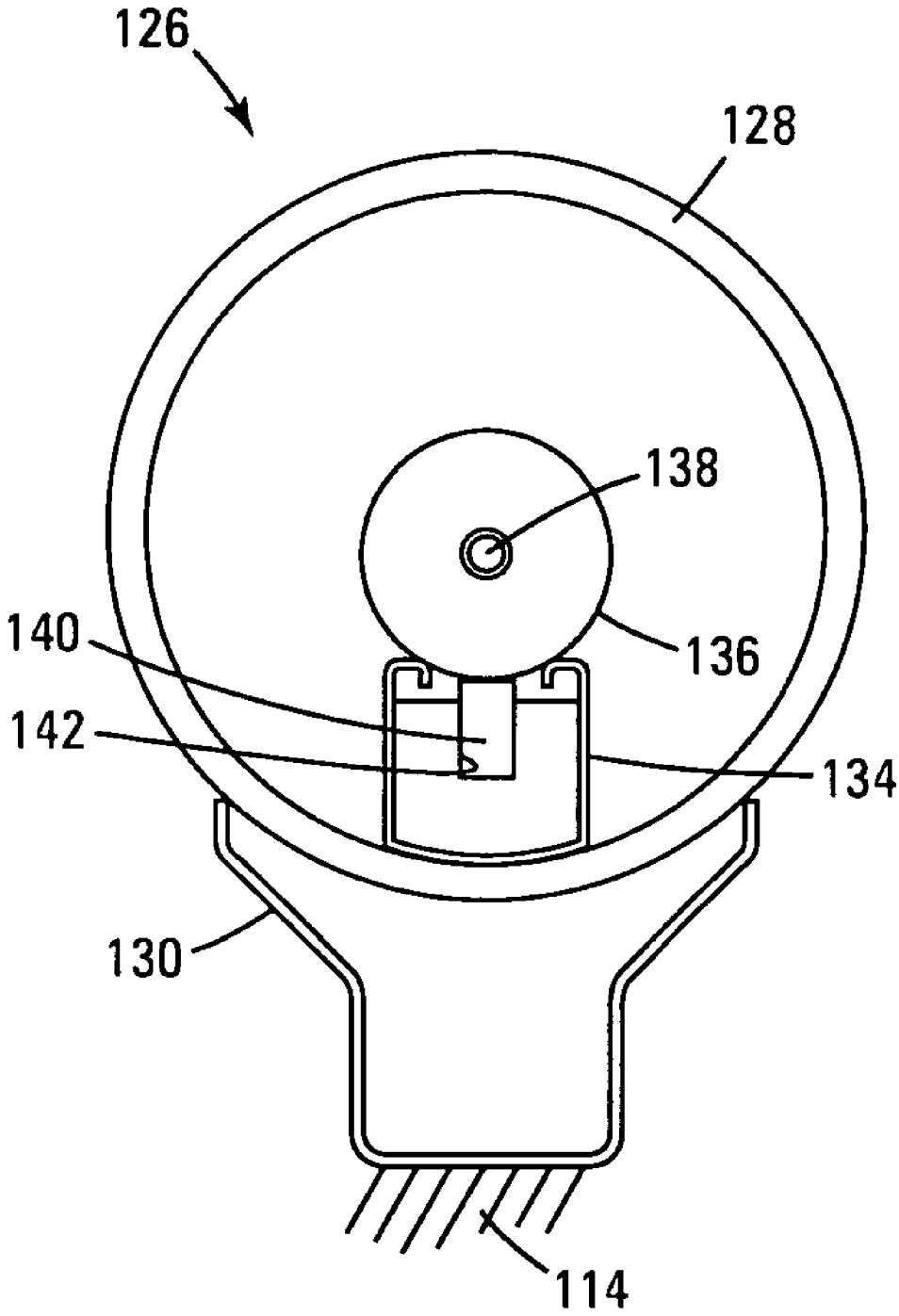
FIG. 3 is a view taken along line 3-3 in FIG. 2.

A fragment-suppression system 126 is contained in chamber 112, as shown in FIG. 2. FIG. 3 is a view of fragment-suppression system 126 taken along line 3-3 in FIG. 2. Fragment-suppression system 126 includes a fragment suppression tube 128 disposed on a stand 130 that is mounted on an interior surface of body 114, as shown in FIGS. 2 and 3. In one embodiment, fragment suppression tube 128 is open at each of its ends 132, as shown in FIG. 2. Fragment suppression tube 128 may comprise any material capable of absorbing or mitigating blast fragments or shrapnel creating by an exploding munition. For some embodiments, stand 130 is of a ceramic material or any other such non-corrosive material. For one embodiment, stand 130 comprises a series of ceramic disks (not shown).

For another embodiment, a container support 134 is disposed within fragment suppression tube 128 on an interior of the fragment suppression tube 128, as shown in FIGS. 2 and 3. Container support 134 is adapted to receive a container 136 containing a biological or chemical material destined for destruction by reactor 100, such as an energetic munition having a burster 138 or a non-energetic munition, or a container containing Chemical Agent Instruction Sets (CAISs), etc., as shown in FIGS. 2 and 3. Container support 134 is further adapted to receive an explosive charge 140, such as a linear-shaped charge, so that charge 140 is disposed between container stand 134 and container 136, as shown in FIGS. 2 and 3. For one embodiment, charge 140 is disposed in a groove 142 of container stand 134, as shown in FIG. 3. In a preferred embodiment, a blast plate 156 is disposed between fragment-suppression system 126 and an interior surface of cover 116, as shown in FIG. 2. For various embodiments, the charge 140 and container support 134 are adapted so that the charge 140 opens the container, accesses the burster 138, and initiates oxidation of a charge of the burster 138 and the contents of the container.

Figure 4:
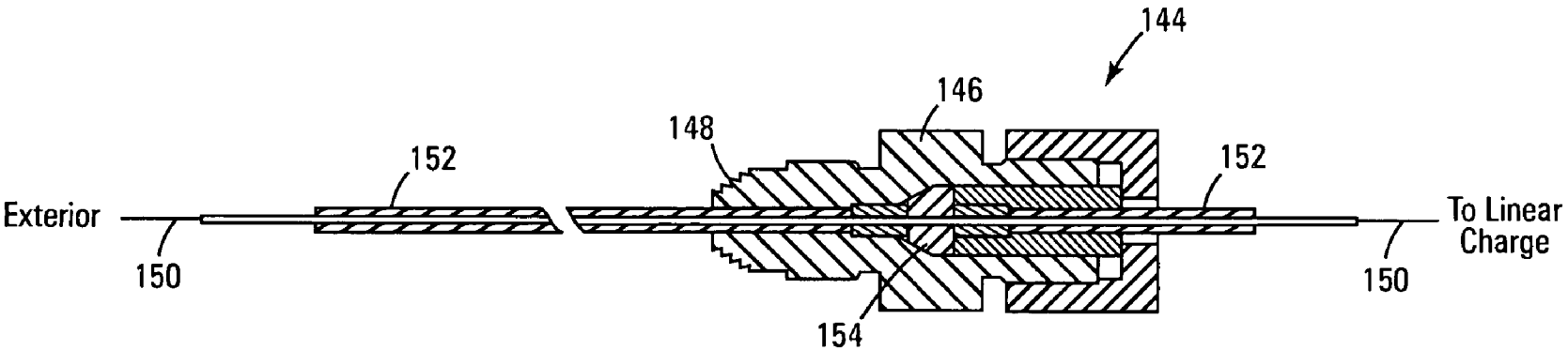
FIG. 4 illustrates a feed-through assembly according to another embodiment of the present invention.

A feed-through assembly 144 passes from internal chamber 112 through cover 116 to an exterior of reactor 100, as shown in FIG. 2. FIG. 4 illustrates feed-through assembly 144 without cover 116 according to another embodiment of the present invention. Feed-through assembly 144 has a fitting 146, shown in FIGS. 2 and 4, having a threaded taper 148 that threads into cover 116 at an interior surface of cover 116. Electrical wires 150 are electrically connected to charge 140 and pass through a tube 152 of feed-through assembly 144 to the exterior of reactor 100, as shown in FIGS. 2 and 4. A seal 154, such as a gland seal, e.g., of polyethylene, disposed in fitting 146 seals tube 152 and thus electrical wires 150 to prevent fluids from escaping from chamber 112 during operation of reactor 100. For one embodiment, feed-through assembly 144 is available from CONAX Buffalo Technologies, Buffalo, N.Y., USA. For another embodiment, fitting 146 is located between blast plate 156 and cover 116, as shown in FIG. 2, and wires 150 pass through blast plate 156. Feed-through assembly 144 can withstand the high voltages required for detonating charge 140 and contains a minimal amount of organic materials that can consume oxygen that can otherwise be used for oxidizing chemical or biological materials.

In another embodiment, a pressure relief device 158, such as a rupture disc, e.g., available from Oseco, Inc., Broken Arrow, Okla., USA, is disposed on end cap 117, as shown in FIG. 2, for protecting reactor 100 against over pressure. A temperature sensor 160, such as a thermocouple probe or the like, passes through end cap 117 for one embodiment. Reactor 100 also includes a sealable injection port 162, e.g., in end cap 117, as shown in FIG. 2. For other embodiments, a relief device 158, a temperature sensor 160, and/or a sealable injection port 162 can be located at other locations on pressure vessel 110 in addition to or instead of at end cap 117, such as at cover 116.

To oxidize a chemical or biological material using reactor 100, container 136 containing the chemical or biological material is disposed within fragment-suppression system 126 so that charge 140 is adjacent to or is in contact with container 136, as shown in FIG. 3. Reactor 100 is then sealed and leak tested. For one embodiment, leak testing involves adding helium to chamber 112, e.g., through injection port 162, and checking for helium leaks. After the helium leak rate is determined to be below an established criterion, the helium is removed from chamber 112 through exit ports (not shown) in reactor 100.

A mixture of an oxidant, e.g., hydrogen peroxide, and water is injected into chamber 112 through injection port 162. For one embodiment, the mixture is about 35 percent hydrogen peroxide and 65 percent water. For another embodiment, a base, such as calcium peroxide, magnesium peroxide, or sodium percarbonate is added to the mixture of water and oxidant to reduce corrosion. A controlled amount of the aqueous hydrogen peroxide solution is injected into chamber 112 for determining the pressure in pressure vessel 110, via the water fraction. Hydrogen peroxide eliminates problems of handling gaseous oxygen. The base provides a counter ion for the acids to reduce corrosion and adds more oxygen for treating more chemical or biological material.

Electrically activating or detonating charge 140 by supplying electrical power to a detonator (not shown) on the charge 140 via electrical wires 150 opens container 136, releasing the chemical or biological agent within container 136 into chamber 112. For one embodiment, charge 140 produces a jet of molten metal that cuts open container 136. In addition, where container 136 is an energetic munition having the burster 138, activating charge 140 causes the burster to detonate or deflagrate resulting in an explosion of container fragments that are contained by fragment suppression tube 128 of fragment-suppression system 126. In this way, fragment-suppression system 126 acts to protect the interior of pressure vessel 110 from exploding container fragments. Moreover, fragment-suppression system 126 is designed to remain in tact and at its fixed location within pressure vessel 110 as the container is opened by detonating the charge 140, i.e., during the explosion of the container fragments, so that fragment-suppression system 126 or fragments thereof do not impact the interior of pressure vessel 110. For another embodiment, the jet of molten metal produced by charge 140 accesses the burster and initiates oxidation of the charge of the burster.

After opening container 138, heaters 122 and 124 are activated to heat the contents of chamber 112 to a temperature above the critical temperature and pressure of water to initiate a supercritical water oxidation process for oxidizing the biological or chemical material contained in chamber 112. For one embodiment, the contents are heated to a temperature between about 1000° F. and about 1100° F. and a pressure between about 3900 psig and about 4200 psig. For some embodiments, the temperature and pressure are maintained at these levels for about 60 minutes to produce environmentally benign materials, such as water, carbon dioxide, sulfur oxide, nitrogen, chloride, and phosphate. Reactor 100 is subsequently cooled to about ambient temperature, and the contents of chamber 112 are sampled to verify that the biological or chemical material is completely oxidized. For one embodiment, this involves sampling a vapor phase for excess oxygen, e.g., using an oxygen sensor, and an aqueous effluent, e.g., water and non-organic salts, for total organic compounds. Sampling can be done through any access port, for example, injection port 162. Typically, an acceptable level of total organic compounds is about 50 ppm. The vapor phase can then be removed by passing it through a carbon filter and the aqueous effluent is drained from reactor 100. If the biological or chemical material is not completely oxidized the contents of chamber 112 are reheated to reinitiate the super critical water oxidation process. Sampling and reheating is repeated until complete oxidation of the chemical or biological material occurs. The cover can then be opened and any solid container fragments removed. For one embodiment, any solids that are removed meet U.S. Army 5X decontamination criteria, meaning commercial recyclers or disposal contractors can handle the solids without further decontamination.

In one embodiment, after opening container 136, but before heating the contents of chamber 112, electrical wires 150 are severed, exteriorly of reactor 100, from a power source that supplied the electrical power to charge 140, and feed-through assembly 144 is closed, e.g., by a plug or cap, at an exterior of cover 116. This acts to seal feed-through assembly 144 during heating, because in some embodiments, seal 154 of feed-through assembly 144 may be damaged during heating.

CONCLUSION

Embodiments of the present invention provide a reactor capable of opening a container such as an energetic or non-energetic munition containing a biological or chemical material and oxidizing the biological or chemical material. The reactor can also safely treat Chemical Agent Instruction Sets (CAISs) without first opening or breaking the vials of the CAISs containing various chemical agents.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any modifications, adaptations or variations of the invention. It is manifestly intended that this invention be limited only by the following claims and equivalents thereof.

What is claimed is:

1. A method of operating a reactor to oxidize and neutralize chemical or biological materials housed in a container, comprising:

placing the container in the reactor and sealing the reactor;

activating a charge disposed within the reactor to open the container disposed within the reactor to release the chemical or biological material into a reaction chamber of the reactor;

injecting an aqueous hydrogen peroxide solution into the reaction chamber, wherein said solution comprises about 35 percent hydrogen peroxide and 65 percent water, and further includes one or more bases selected from the group consisting of calcium peroxide, magnesium peroxide, sodium percarbonate, and mixtures thereof; and heating the chemical or biological material with the hydrogen peroxide, water, and bases contained within the chamber to a temperature of between 1,000 and 1,100° F. and a pressure of between 3,900 and 4,200 psig to initiate a supercritical water oxidation process.

2. The method of claim 1, wherein said charge is a linear shaped charge and activating the charge produces a metal jet that cuts through the container.

3. The reactor of claim 1, wherein said container is an energetic munition having a burster, and said charge is adapted to access the burster.

4. The method of claim 3, wherein activating the charge detonates or deflagrates the burster of the container.

5. The method of claim 1, further comprising containing exploding fragments of the container within a fragment-suppression system of the reactor after opening the container.

6. The method of claim 1, wherein activating the charge is in response to receiving electrical power at the charge.

7. The method of claim 1, wherein said base comprises sodium percarbonate.

8. A method for oxidizing a chemical or biological material, the method comprising:

disposing a container containing the chemical or biological material within a tube of a fragment-suppression system located within a chamber of a reactor;

adding an aqueous hydrogen peroxide solution into the reaction chamber, wherein said solution comprises about 35 percent hydrogen peroxide and 65 percent water, and further includes one or more bases selected from the group consisting of calcium peroxide, magnesium peroxide, sodium percarbonate, and mixtures thereof;

activating a charge disposed within the fragment-suppression system to open the container to release the chemical or biological material into the chamber; and heating the chemical or biological material with the aqueous hydrogen peroxide solution and base to a temperature of between 1,000 and 1,100° F. and a pressure of between 3,900 and 4,200 psig to initiate a supercritical water oxidation process.

9. The method of claim 8, further comprising containing exploding fragments of the container within the tube after opening the container.

10. The method of claim 8, wherein said base comprises sodium percarbonate.

* * * * *